United States Patent [19]

Sperline

[11] 4,088,110

[45] May 9, 1978

[54] ENGINE IDLE CONTROL

[75] Inventor: Paul D. Sperline, Kennewick, Wash.

[73] Assignee: SPS Instrument Company, Pasco, Wash.

[21] Appl. No.: 736,867

[22] Filed: Oct. 29, 1976

[51] Int. Cl.[2] ..... F02B 77/00

[52] U.S. Cl. ..... 123/198 DB; 123/198 DC; 123/148 S

[58] Field of Search ..... 123/198 DB, 198 DC, 123/102, 198 D, 148 S

[56] References Cited

U.S. PATENT DOCUMENTS

| | | | |
|---|---|---|---|
| 2,861,558 | 11/1958 | McClain | 123/198 DC X |
| 3,241,539 | 3/1966 | Kuehn | 123/198 DC |
| 3,680,539 | 8/1972 | Savage et al. | 123/198 DB |

*Primary Examiner*—Charles J. Myhre
*Assistant Examiner*—Ira S. Lazarus
*Attorney, Agent, or Firm*—Wells, St. John & Roberts

[57] ABSTRACT

An automatic control for continuing idle operation of an internal combustion engine, particularly a diesel motor, to provide proper engine conditioning before the engine is shut down. Automatic control circuitry is added by connection to the contacts of a conventional manual control switch for the engine. Normally open contacts of a relay are pre-set during engine use to bypass the manual control switch for a predetermined time following subsequent opening of the switch. A first electronic detector monitors the closing of the switch, while a second electronic detector monitors its opening. The two detectors operate both the relay and an electronic timing mechanism. The timing mechanism opens the relay contacts following a predetermined period after the opening of the manual control switch. In this way shutdown of the engine is accomplished electronically as an automatic function following the manual opening of the usual key switch.

1 Claim, 1 Drawing Figure

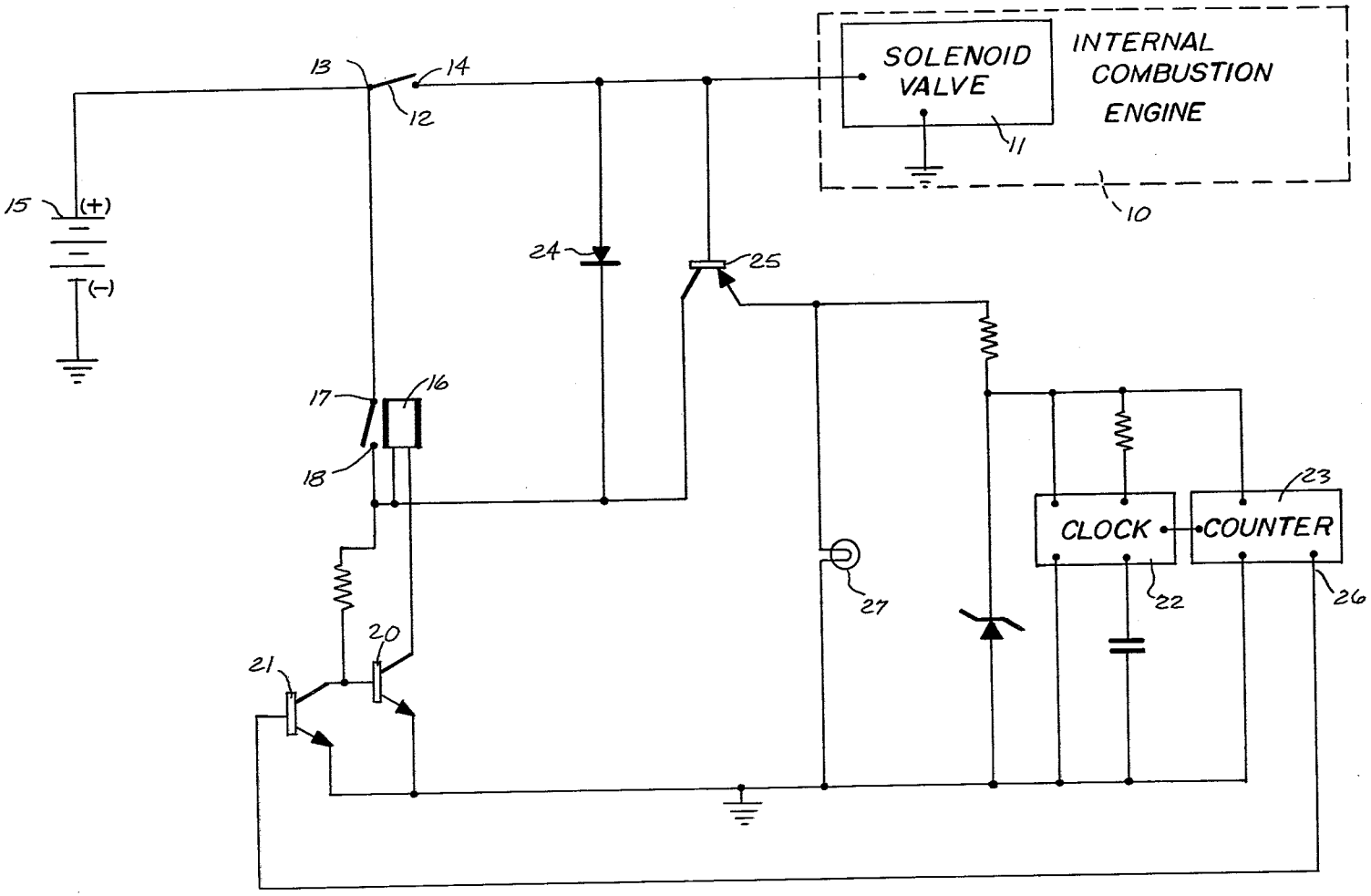
INTERNAL COMBUSTION ENGINE
10
SOLENOID VALVE
11
COUNTER
23
26
CLOCK
22
27
25
24
14
12
13
16
17
18
20
21
15
(+)
(-)

ENGINE IDLE CONTROL

BACKGROUND OF THE INVENTION

This disclosure relates to a time delay control for an internal combustion engine, particularly a diesel engine. It is designed as an accessory which can be added to a vehicle or other engine installation without modification of the normal engine wiring. None of the accessory circuits is interposed in the conventional ignition wiring, and any possible malfunction in the accessory will not affect normal engine operation. The cooling idle period for the engine is timed automatically without any effort on the part of the operator.

A prior control of this type is disclosed in U.S. Pat. No. 3,680,539, which was granted Aug. 1, 1972. This control, which has seen successful utilization with respect to diesel engines, requires manual setting prior to opening the ignition switch. While this operates very successfully, many owners of diesel engines would prefer a fully automatic control that does not require any activation by the engine operator.

To accomplish this, a complete new electronic circuit is provided according to the present disclosure. The electronic circuit utilizes solid state devices that consume very little power and which have extreme reliability adaptable to the environment in which the control circuitry is utilized.

SUMMARY OF THE INVENTION

The invention broadly includes an accessory or attachment for an internal combustion engine having an electrical power control circuit that controls operation of an electrical load device. The usual direct current battery is used as a source of electrical power. The normal key-operated switch is utilized as the conventional manual control switch. The contacts of the switch are closed during normal operation of the engine power circuit and are open when the power circuit is normally inoperative. The accessory circuit is designed to maintain the engine power circuit operative for a preselected time following the opening of the manual control switch.

The accessory circuit includes a relay having a coil and a pair of normally nonconductive contacts or terminals controlled by the coil. A first relay terminal is connected to the first contact of the manual switch at its battery side. The second relay terminal is operatively wired in series with the coil to the remaining side of the battery.

A normally conductive transistor switch circuit is operatively wired in series between the second relay terminal and the remaining side of the battery.

Electronic timing means is provided for producing an electric signal at its output following a predetermined period after its activation.

First electronic sensing means in the form of a diode is connected between the engine side of the manual control switch and the second relay terminal for detecting the closing of the manual control switch. Upon detecting such closing, it completes a current path across the power source through the relay terminals.

Second electronic switching means in the form of a transistor is operatively connected between the load contact of the manual control switch and the second relay terminal. It has normally nonconductive terminals wired in series between the second relay terminal and the electronic timing means. It detects the opening of the manual control switch and then activates the electronic timing means.

The output of the electronic timing means is operatively connected to the electronic switching means for causing the normally conductive terminals thereof to become nonconductive upon receipt of the electrical signal produced by the electronic timing means. This opens the power circuit to the relay and shuts down the engine through the operation of the electrical load device.

It is a first object of this invention to provide a fully automatic electronic accessory circuit to control operation of an internal combustion engine for a predetermined period of time following opening of the engine electric control circuit. No manual operation of any type is required.

Another object of the invention is to provide a reliable circuit for this purpose, utilizing solid state devices.

Further objects will be evident from the following discussion, which describes a preferred embodiment of the invention as illustrated in the accompanying drawing.

DESCRIPTION OF THE DRAWING

The drawing FIGURE represents a schematic diagram of the automatic engine controls.

DESCRIPTION OF THE PREFERRED EMBODIMENT

The apparatus described below is designed specifically to facilitate idling of diesel engines or other types of internal combustion engines where it is desirable to allow a few minutes of idle operation just before shut down after normal engine operation under load. Such idle operation is normally required by diesel engine manufacturers to permit the internal temperature of the engine to stabilize before shutdown. Proper engine cooling increases engine efficiency and increases its normal life. Automatic control of the idling sequence also reduces air pollution by minimizing the length of required engine operation prior to shut-down and by assisting in the improvement of engine maintenance and efficiency. The apparatus permits the operator of the engine to manually initiate the idle operation, remove the engine key or other control element, and leave the engine running at idle. The device will then shut down the engine after a preselected period of time.

The drawing illustrates a schematic diagram of a control circuit for idling an internal combustion engine, particularly a diesel engine, after removal of the usual key from the controlling key switch in the engine's electrical system. In the case of a diesel engine, the controlling switch is either connected to the solenoid operated fuel control valve on the fuel pump or the solenoid engine cutoff on the injector control rack. In the case of a gasoline engine, the key operated switch is interposed in the ignition system. The controlling switch may or may not be key operated, but is manually opened and closed in some fashion. It might also be interlocked with other devices that operate the switch in conjunction with other manual control functions, such as a brake lever, transmission control, or throttle. The control circuit described herein is applicable to the control of other devices, motors and engines, and is generally useful in sequentially operating a device by control of an electrical circuit.

The drawing schematically illustrates the application of the control circuit to a typical electrical system for an internal combustion engine, whether used in a vehicle or at a stationary location. The purpose of the circuit is to idle the engine for a short period of time before shutdown. This idling operation is attained automatically without manual effort on the part of the operator, and without requiring that the operator continue monitoring the engine after his use of it has been completed.

In the normal electrical control circuitry for such an engine, indicated generally by the numeral 10 in the drawings, there is a battery or source of direct current electrical energy, a switch 12, which is typically key operated and serves as the manual control switch for the engine, and an electrical load device, illustrated as solenoid valve 11. The valve 11 might be a conventional solenoid operated fuel control valve mounted on the fuel pump of a diesel engine or a solenoid engine cutoff valve mounted on the injector control rack.

The first and second contacts 13, 14 of the switch 12 are selectively closed to complete a power circuit across the terminals of battery 15 during normal operation of the engine. This power circuit is typically opened when the engine is shut down by opening switch 12. In some engine applications, the opening of switch 12 must be combined with other manual or automatic functions to properly shut down the engine. The present control circuitry can be applied to any of these conventional arrangements.

In the illustrated embodiment, the negative terminal of battery 15 is grounded and its positive terminal is connected in the power circuit to the first contact 13 of the manual control switch 12. The second contact 14 of switch 12 is wired to the grounded electrical equipment or load, illustrated as solenoid valve 11.

The present control circuitry is connected in parallel with the existing circuitry and does not require any modification or revision of the wiring as designed and installed by the manufacturer of the engine. The control circuitry can be housed within a single sealed enclosure (not shown) and can be mounted on an engine dashboard or on any available control panel.

The control circuitry includes a relay including a coil 16 and first and second normally open terminals 17, 18. The coil serves as energizing means to control opening and closing of the terminals 17, 18. While an electromechanical relay is illustrated, equivalent electronic components can be incorporated into the circuit when desired.

The first terminal 17 for the relay is operatively wired to the first contact 13 of the manual control switch 12. The second terminal 18 of the relay is operatively wired, in series with coil 16, to the grounded terminal of battery 15 through electronic switching means comprising transistors 20, 21.

During normal use of the engine, the relay is operated by means of a diode 24 wired between the second contact 14 of switch 12 and the second terminal 18 of the relay. Diode 24 is capable of completing a direct current circuit from the second contact 14 of switch 12 through the relay coil 16 and transistor 20 to ground. The diode 24 serves as a first electronic sensing means to detect closing of the manual control switch 12. This detection function is accomplished by completing a circuit through coil 16 to thereby close the circuit through the relay terminals 17, 18. Transistor 20 is wired in series with coil 16 so as to be normally conductive during the usual operation of the internal combustion engine 10.

A second electronic sensing means (shown in the form of a transistor 25) is interposed between the second contact 14 of switch 12 and the second terminal 18 of the relay. The base of transistor 25 is connected to the second contact 14, and its collector is wired to the second terminal 18 of the relay. These connections permit the transistor 25 to function as a diode between the relay and switch.

A conventional timer 22 and counter 23 is utilized to provide electronic timing for operation of solenoid valve 11. Both are preferably integrated circuits, the timer being a 555 circuit and the counter being a 14040 counter circuit. The electronic spikes from the timer 22 are fed to the counter 23. A conventional reset circuit is used as an input to counter 23. When the requisite number of spikes has been counted, the counter 23 produces an output signal at its output terminal shown at 26. The output terminal 26 is connected to the base of transistor 21 in the electronic switching means interposed between the relay coil 16 and ground.

To understand operation of the apparatus, it is necessary to study the various components during the usual steps taken to control the engine 10.

First, with the engine at rest, the switch 12 is open and no current is drawn by any of the components illustrated in the drawing.

When the switch 12 is closed to start or operate the engine 10, the solenoid valve 11 is operated and there is a momentary current path established through diode 24, coil 16 and the conducting terminals of transistor 20 to ground. The completion of a circuit through the coil 16 closes the relay terminals 17, 18 to maintain the circuit. Transistor 25 remains nonconducting and the electronic timing means is inoperative during the usual functioning of the engine 10. No current is passed by transistor 25 to the electronic timing means as there is no bias on the base to the collector of the transistor 25. Until the relay terminals 17, 18 close, transistor 25 is reverse biased. When the terminals 17, 18 of the relay are closed, the diode 24 will no longer conduct current and transistor 25 will be forward biased.

When the switch 12 is opened, a current path will be established through the relay terminals 17, 18 to maintain the circuit of transistor 20 and the forward bias of transistor 25. The base current through transistor 25 operates the solenoid valve 11. The emitter of transistor 25, which is now conductive, furnishes electrical power to initiate operation of the timer 22. A signal lamp 27 is shown wired across the timer to provide a visual indication to the user to verify that the circuit is operative after opening of switch 12. The timer 22 and counter 23 then electronically measure a predetermined period of time (such as four minutes), while the components remain in a steady state continuing operation of the solenoid valve 11.

At the completion of the predetermined time period, an electrical pulse is produced at the output 25 in counter 23, which is applied to the base of transistor 21. This causes transistor 21 to become conductive and pull the base of transistor 20 to ground, thereby turning off transistor 20. Transistor 20 thereby serves as an electronic switch to open the circuit to the relay coil 16, which in turn opens the relay terminals 17, 18 and shuts down the entire apparatus. This returns the apparatus to its original state with the solenoid valve 11 inoperative and switch 12 open in preparation for subsequent use of the engine 10. The above automatic sequence assures cooling of engine 10 after its use. Idle operation is always timed automatically for a predetermined period following opening of the operator's key switch 12.

The electrical components illustrated are only examples of those which can be designed and chosen for this purpose. Equivalent electronic or electro mechanical devices can be substituted when desired, so long as the functional relationship remains basically as described above.

For reasons of emergency, a system to manually override the automatic apparatus might be interposed. This can be done by interposing a normally closed manual switch (not shown) in the line leading directly to the solenoid valve 11 or in series with the terminals 17, 18 of the relay. A normally open manual switch (not shown) might also be interposed between the base of transistor 20 and ground.

The control circuitry described above does not require alteration of the existing wiring in the vehicle. The usual reliability of the engine is not jeopardized in any manner should the timing mechanism fail to operate. In any respect, idling and cooling of the engine can be assured by the usual key operation of the switch 12 under the control of an operator.

Having thus described my invention, I claim:

1. In an apparatus for maintaining operation of the electrical power control circuit of an internal combustion engine for a preselected period of time, the combination with an internal combustion engine, a direct current electrical power source, an electrical load device operable to shut down the engine, and a power circuit connecting said power source to said electrical load device; said power circuit including a manual control switch having a first contact operatively connected to one side of the power source and a second contact operatively connected in series with the electrical load device to the remaining side of the power source; the manual control switch contacts being closed during normal operation of the power circuit and being open when the power circuit is normally inoperative;

the improvement comprising:

relay means including energizing means and a pair of normally nonconductive terminals controlled thereby and adapted to be rendered conductive upon activation of said energizing means, a first terminal of the relay means being operatively wired to the first contact of the manual control switch, the second terminal of the relay means being operatively wired in series with said energizing means to the remaining side of the power source;

electronic switching means having normally conductive terminals operatively wired in series between said second terminal of the relay means and the remaining side of the power source;

electronic timing means having an output terminal for producing an electrical signal at said output terminal following a predetermined period of time after activation of the electronic timing means;

first electronic sensing means operatively connected between the second contact of the manual control switch and said second terminal of the relay means for detection of the closing of the manual control switch, said first electronic sensing means being operable, upon detecting the closing of the manual control switch, to complete a current path across the power source through the manual control switch, the energizing means and the normally conductive terminal of said electronic switch means to thereby cause the first and second terminals of the relay means to be conductive;

second electronic sensing means operatively connected between the second contact of the manual control switch and the second terminal of the relay means and having normally nonconductive terminals wired in series between said second terminal of the relay means and said electronic timing means for detection of the opening of the manual control switch, said second electronic switching means being operable to activate said electronic timing means upon detecting an opening of the manual control switch;

the output terminal of said electronic timing means being operatively connected to said electronic switching means for causing said normally conductive terminals thereof to become nonconductive upon production of an electrical signal by said electronic timing means, thereby opening the power circuit to said energizing means.

* * * * *